US006494265B2

(12) United States Patent
Wilson et al.

(10) Patent No.: US 6,494,265 B2
(45) Date of Patent: Dec. 17, 2002

(54) FLOW CONTROL DEVICE

(75) Inventors: James B Wilson, Nailsea (GB); Christopher R King, Stroud (GB)

(73) Assignee: ABB Offshore Systems Limited (GB)

( * ) Notice: Subject to any disclaimer, the term of this patent is extended or adjusted under 35 U.S.C. 154(b) by 0 days.

(21) Appl. No.: 09/731,396

(22) Filed: Dec. 4, 2000

(65) Prior Publication Data

US 2002/0020534 A1 Feb. 21, 2002

(30) Foreign Application Priority Data

Aug. 17, 2000 (GB) ..... 0020350

(51) Int. Cl.[7] ..... E21B 34/14; E21B 34/00

(52) U.S. Cl. ..... 166/332.1; 166/386; 166/320; 137/315.07

(58) Field of Search ..... 166/332.4, 332.7, 166/386, 387, 334.1, 320, 332.1, 374, 319; 137/315.07, 508

(56) References Cited

U.S. PATENT DOCUMENTS 4,360,064 A * 11/1982 O'Connor et al. ..... 166/319
4,944,349 A 7/1990 Von Goten, Jr.
5,156,220 A * 10/1992 Forehand et al. ..... 166/332.7
5,263,683 A 11/1993 Wong
5,316,084 A 5/1994 Murray et al.
6,044,908 A 4/2000 Wyatt
6,059,038 A * 5/2000 Vick, Jr. ..... 166/319
6,112,816 A * 9/2000 Orzechowski et al. ..... 166/324
6,260,616 B1 * 7/2001 Carmody et al. ..... 137/614.11

FOREIGN PATENT DOCUMENTS

| | | |
|---|---|---|
| GB | 1060018 | 2/1967 |
| GB | 2 261 719 A | 5/1993 |
| WO | WO 99/05387 | 2/1999 |

* cited by examiner

*Primary Examiner*—David Bagnell
*Assistant Examiner*—Daniel P Stephenson
(74) *Attorney, Agent, or Firm*—Kirschstein, et al.

(57) ABSTRACT

A flow control device comprises an outer sleeve having at least one aperture through its wall, and an inner sleeve having at least one aperture through its wall. Relative sliding movement of the sleeves is provided between "open" positions allowing for variable flow of fluid through the apertures of the sleeves and "closed" positions. A pressure-reducing region is arranged to reduce the pressure of fluid flowing through at least one aperture of one of the sleeves.

7 Claims, 6 Drawing Sheets

FLOW CONTROL DEVICE

TECHNICAL FIELD

This invention relates to flow control devices, such as chokes for hydrocarbon wells.

BACKGROUND OF INVENTION

In a hydrocarbon well, chokes control flow of fluid into production tubing from the well bore or into regions of the well bore from the production tubing. Conventionally, such chokes have been simple on/off devices that merely filly opened or fully closed the production tubing. Recently, there has been a requirement for variable flow control which has given rise to particular problems. A conventional variable flow control choke is shown in the schematic drawing of FIG. 1*a*.

The basic features of this device are an outer sleeve 1 and an inner sleeve 2, each having respective sets 3, 4 of apertures located about their respective circumferences. The outer sleeve 1 may be an integral part of a section of production tubing. The inner sleeve 2 is slidably moveable by means of an actuator (not shown). FIG. 1*a* shows the location of the sleeves in a "closed" position. FIGS. 1*b* and 1*c* show the relative positions of the sleeves in two different "open" positions—partly open and fully open, respectively. The arrows of FIGS. 1*b* and 1*c* represent the flow of fluid from the well bore into the production tubing via the apertures 3, 4.

Annular seals 5, 6 and 7 are located between the inner 2 and outer 1 sleeves. These seals separate the annular gap between the inner and outer sleeves into chambers whilst allowing the inner sleeve to move freely. For example, there is an annular chamber 8 between seals 6 and 7, which chamber includes the apertures 3 of the outer sleeve 1.

Activation of the actuator causes the inner sleeve 2 to be moved in the direction of the arrows shown in FIG. 1*a*. FIG. 1*b* shows the apparatus of FIG. 1*a* in a partially open position, wherein the apertures 4 of the inner sleeve encroach on the chamber 8, thereby opening up a flow path. In the fully open position of FIG. 1*c*, the apertures 4 of the inner sleeve are located entirely within the chamber 8.

Various problems may be encountered with this conventional type of flow control device. For example, as the device begins to enter an "open" position, pressure on one side of the seal tends to distort the seal and extrude it in the direction of fluid flow. Therefore, in the example shown in FIG. 1*b*, the seal 6 tends to be extruded into the apertures of the inner sleeve. Should the fluid flow be in the opposite direction (i.e. from the production tubing to the well bore), the seal tends to extrude into the annular gap between the sleeves.

Another problem with this type of flow control device is that, at the point of opening, the fluid is flowing very quickly through the apertures, and at high pressure, with the result that the seal 6 can be damaged or dragged into the apertures 4 of the inner sleeve.

The high velocity of the fluid flow in the "just open" position of FIG. 1*b* can also cause another problem, namely that of erosion of the edges of the apertures, particularly when the fluid is contaminated with solid particles such as sand. Yet another problem which may be encountered with conventional flow control devices is that the increase in fluid flow rate is not linear with linear movement of the tube and so accurate variable flow control is difficult, especially when low flow rates are required.

SUMMARY OF THE INVENTION

In accordance with a first aspect of the invention there is provided a flow control device comprising an outer sleeve having at least one aperture through its wall, an inner sleeve having at least one aperture through its wall and means for providing relative sliding movement of the sleeves between "open" positions allowing variable flow of fluid through the apertures of the sleeves and "closed" positions, characterised by a pressure-reducing region arranged to reduce the pressure of fluid flowing through the at least one aperture of one of the sleeves.

The provision of a pressure-reducing region reduces the risk of damage of the seal 6 and reduces the likelihood of it being dragged into the apertures of the sleeve. Furthermore, erosion of the apertures is reduced.

According to a second aspect of the invention, there is provided a flow control device comprising an outer sleeve having at least one aperture through its wall, an inner sleeve having at least one aperture through its wall, means for providing relative sliding movement of the sleeves between "open" positions allowing variable flow of fluid through the apertures of the sleeves and "closed" positions and a sealing arrangement between the inner and outer sleeves comprising at least one seal, characterised by seal bypass means arranged to permit a portion of fluid to seep around the seal so that the fluid pressure acting on a region of the seal is reduced.

The provision of a seal bypass reduces the likelihood of extrusion of the seal which was hitherto encountered. As the fluid seeps around the seal, the pressure on the opposite sides of the seal tends to equalise.

According to a further aspect of the invention, there is provided a flow control device comprising an outer sleeve having at least one aperture through its wall, an inner sleeve having at least one aperture through its wall and means for providing relative sliding movement of the sleeves between "open" positions allowing variable flow of fluid through the apertures of the sleeves and "closed" positions, characterised in that an edge region of the at least one aperture of one of the sleeves includes erosion resistant means.

The provision of an erosion resistant means prolongs the lifetime of the flow control device. Preferably the erosion resistant means includes tungsten.

A further aspect of the invention comprises the provision of tapered edge regions for the apertures of the sleeves, also for the purpose of reducing erosion.

According to yet another aspect of the invention there is provided a flow control device comprising an outer sleeve having a set of apertures through its wall, an inner sleeve having a set of apertures through its wall and means for providing relative sliding movement of the sleeves between "open" positions allowing variable flow of fluid through the apertures of the sleeves and "closed" positions, characterised in that one set of apertures includes an aperture extending beyond the others in the direction of opening movement.

The provision of the extended aperture enables low flow rates to be achieved when the device enters a "just open" position.

Preferably the shape, size and spacing of the apertures is arranged to provide a constant percentage change of the velocity co-efficient characteristic of the fluid with linear movement of the inner sleeve.

The invention will now be described, by way of example, with reference to the accompanying drawings.

BRIEF DESCRIPTION OF THE DRAWINGS

Like reference numerals apply to like parts throughout the specification.

DETAILED DESCRIPTION OF THE INVENTION

Figure 2:
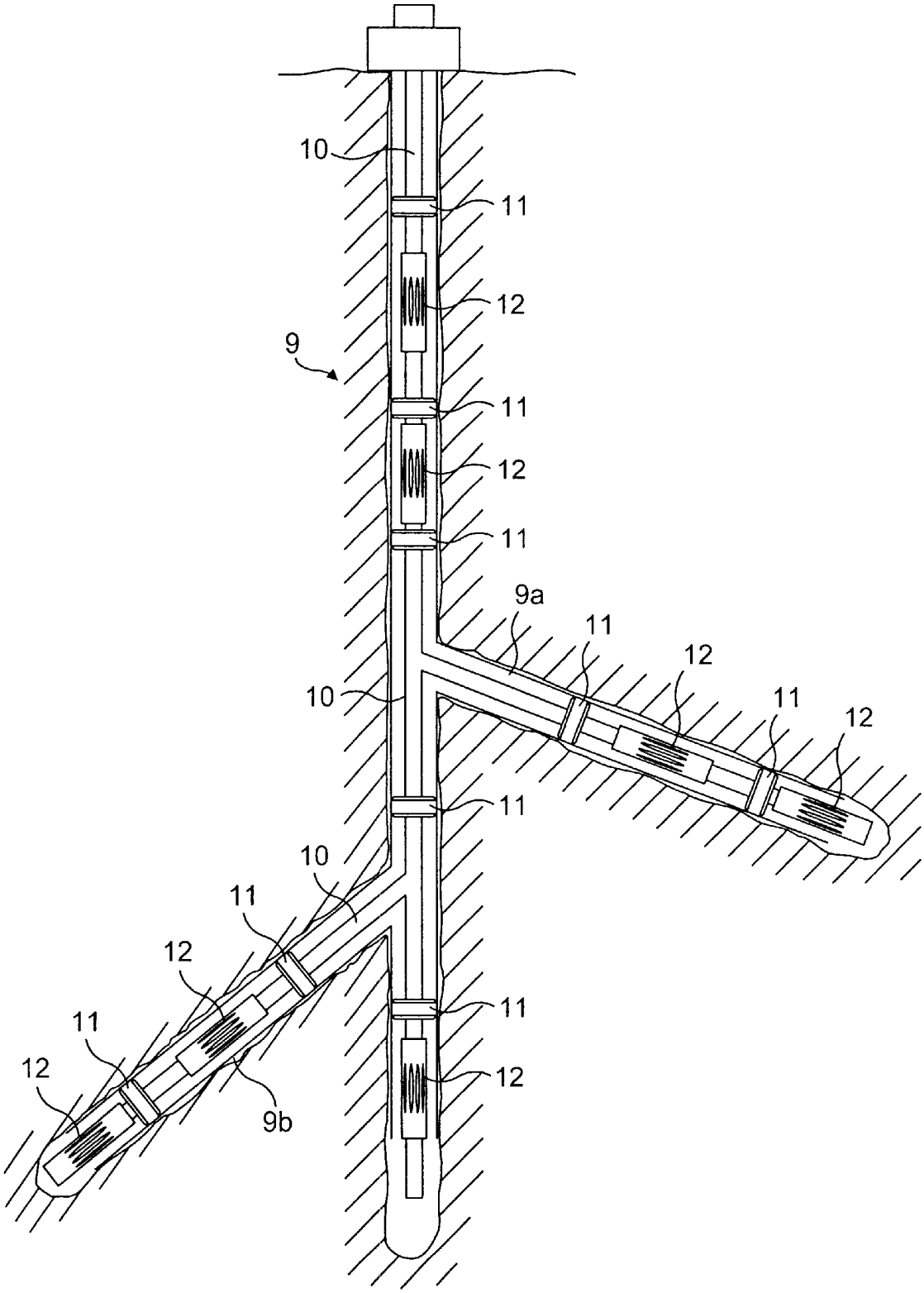
FIG. 2 is a schematic diagram showing an arrangement of flow control devices in a subsea well bore.

With reference to FIG. 2, there is shown a typical arrangement of a well bore, indicated generally by the reference numeral 9, with a number of branches 9*a,* 9*b.* Production tubing 10 extends from the mouth of the bore to oil reservoirs. The space between the tubing and the well bore is sealed at points along its length by means of devices 11 known as packers. Interposed between adjacent packers are chokes 12 which are each operated by actuators (not shown). In use, oil or other hydrocarbon fluids enter the production tubing 10 through the apertures in the choke devices 12, if open. The selection and operation of the motors associated with the choke actuators is carried out by operator selection by means of a surface control display. Sensors (also not shown) may be employed to provide the operator with accurate information regarding the position and condition of the chokes 12.

Figure 1A:
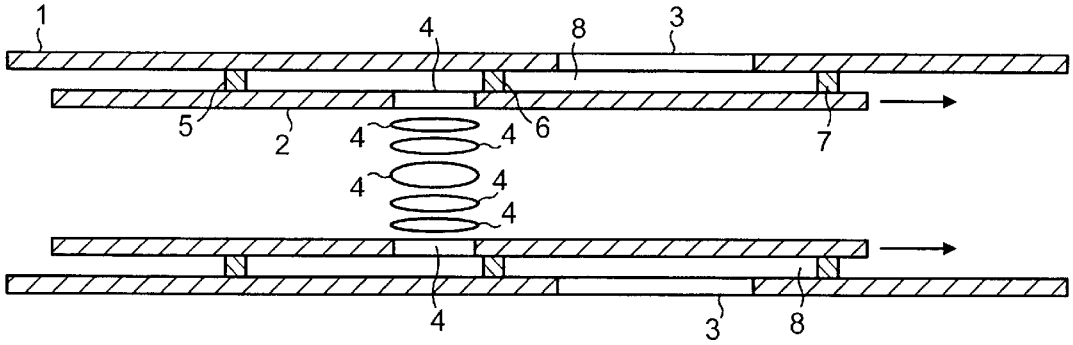
FIG. 1A PRIOR ART
FIGS. 1*a*–1*c* are schematic cross sectional views of a conventional flow control device in closed and open positions.
Figure 1B:
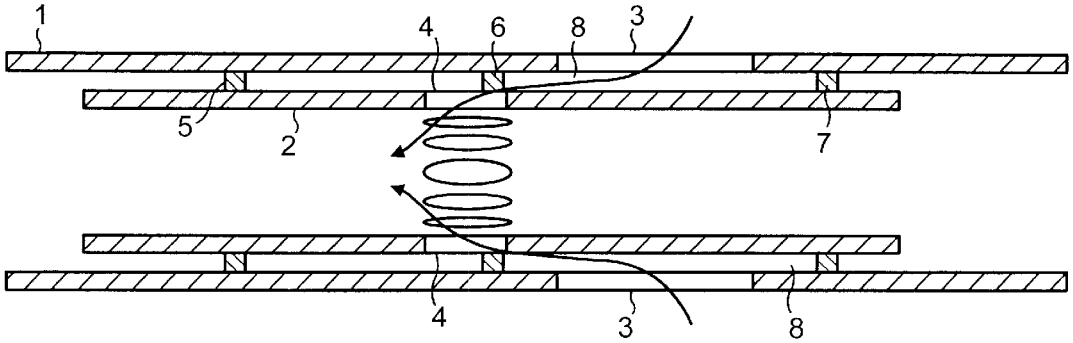
FIG. 1B PRIOR ART
Figure 1C:
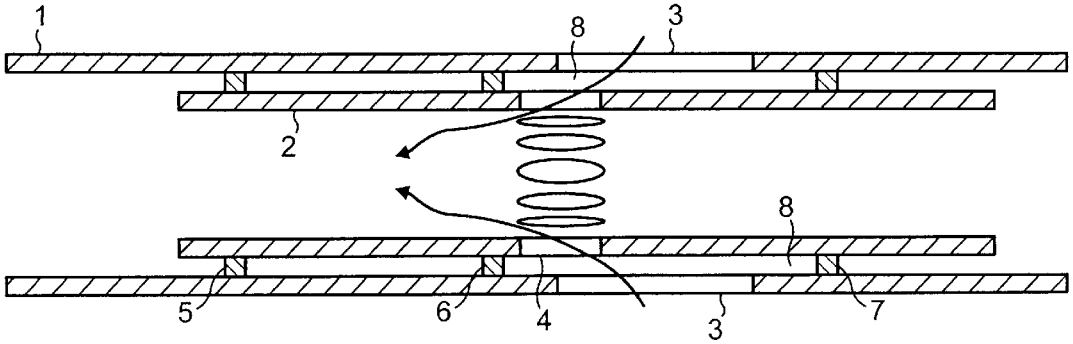
FIG. 1C PRIOR ART
Figures 3A, 3B:
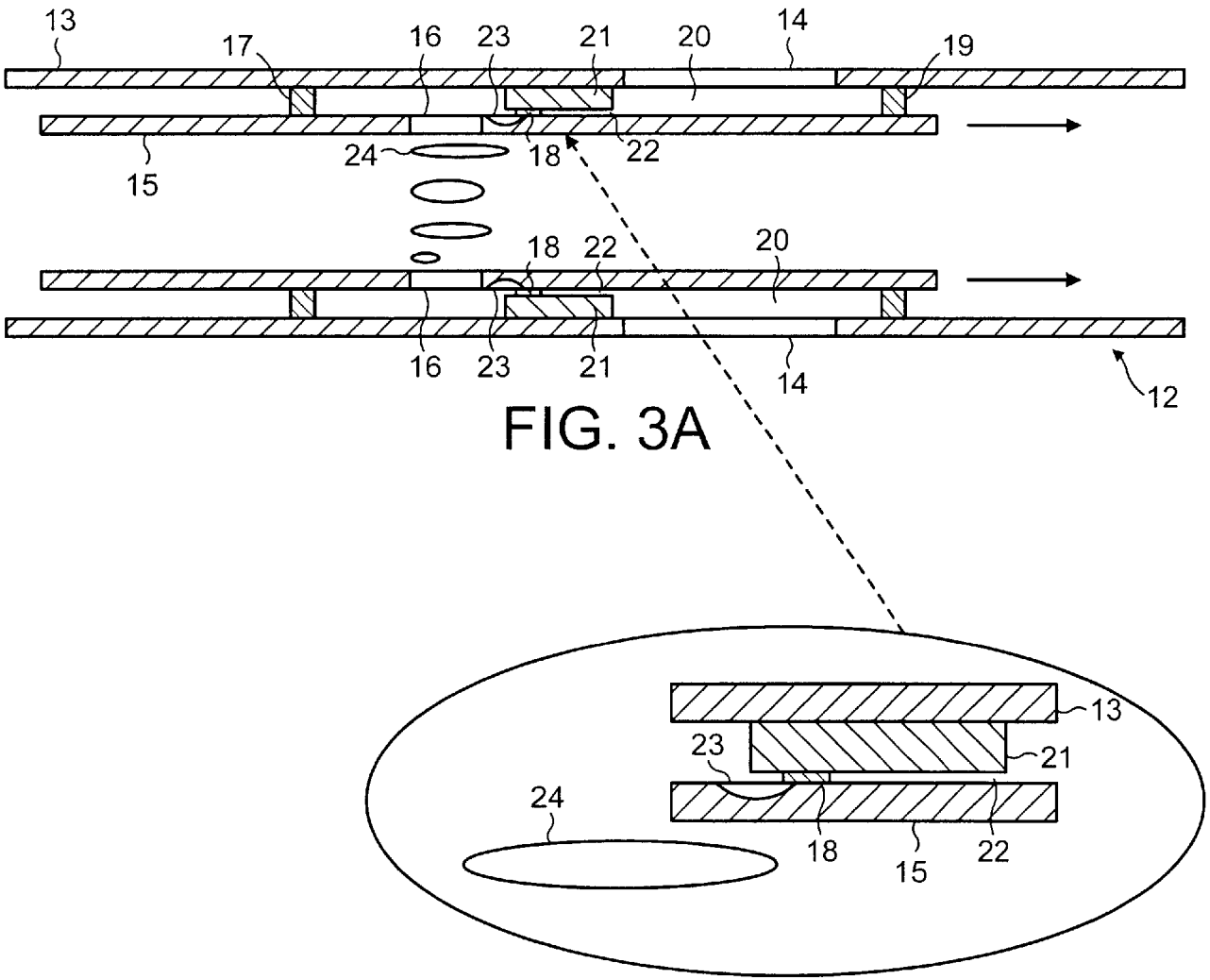
FIG. 3*a* is a schematic cross sectional view of apparatus constructed according to various aspects of the invention.
FIG. 3*b* is a more detailed view of part of the apparatus of FIG. 3*a;*

FIG. 3*a* illustrates a choke 12, or flow control device, constructed according to the various aspects of the invention. This flow control device has the same basic features as that shown in FIGS. 1*a*–1*c,* namely an outer sleeve 13 having a set 14 of apertures, an inner sleeve 15 having a set 16 of apertures, a sealing arrangement 17, 18, 19 and an actuator (not shown) arranged to move the inner sleeve 15 relative to the outer sleeve 13. The arrangement of the seals 18 and 19 defines an annular chamber 20, between the sleeves, incorporating the set 14 of apertures of the outer sleeve. FIGS. 3*a*–3*e* illustrate the principles behind the inventive features of the flow control device and are not intended to accurately reflect the dimensions of an actual device. For example, it is unlikely that the annular seal 17 would be as close in proximity to the seal 18 as is shown in the drawings.

In accordance with a first aspect of the invention there is provided a pressure-reducing region in the form of an annular insert 21. The annular insert 21 is interposed between the seal 18 and the outer sleeve 13. The insert 21 forms a region of reduced size in the form of a narrow annular passage 22 in front of the seal 18. The annular insert 21 is shown in the more detailed drawing of FIG. 3*b,* as is one 23 of a set of grooves scored into the outer surface of the inner sleeve 15. The grooves 23 are located just before the apertures 16 of the inner sleeve 15 in the direction of opening movement. The function of both the annular insert 21 and the grooves 23 will be described later in this specification.

Another feature of the choke of FIG. 3*a* is that the apertures 16 of the inner sleeve 15 are of different shapes and sizes. At least one 24 of the apertures of this set 16 extends beyond the others in the direction of opening movement of the flow control device, which direction is shown by the arrows.

Figure 3C:
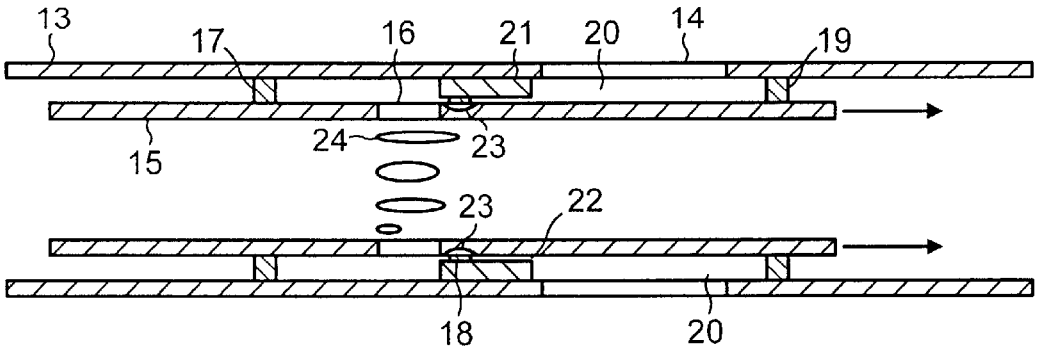
FIGS. 3*c*–3*e* illustrate the apparatus of FIG. 3*a* at various stages of opening.

Referring now to FIG. 3*c,* this shows commencement of an opening operation by the actuator, which is moving the inner sleeve 15 in the direction shown in the arrows. In this drawing the grooves 23 bridge the seal 18 and are now impinging on the chamber 20, which chamber includes the apertures 14 of the outer sleeve 13. Thus, hydrocarbon fluid entering the chamber 20 from the well is permitted to seep around the grooves, bypassing the seal 18, even though the choke 12 has not attained an "open" position. This has the effect of balancing fluid pressure on both sides of the seal 18 prior to the flow control device entering an open position, thus reducing the problem of extrusion of the seal, which was hitherto caused by high pressure of the in flowing fluid acting on this seal.

Figure 3D:
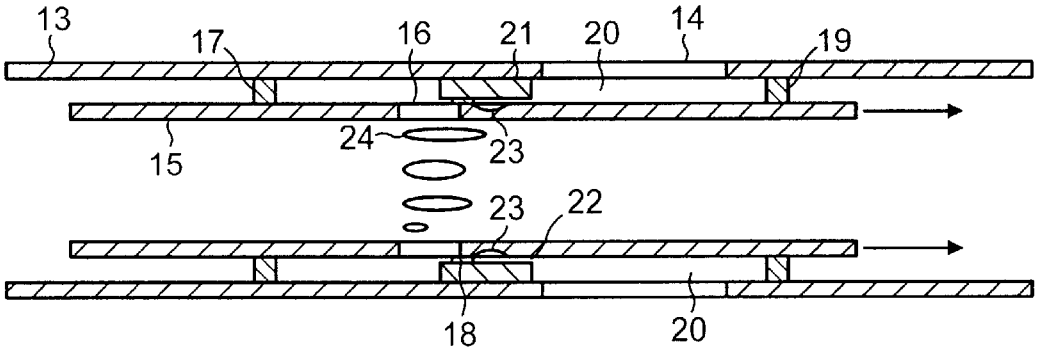

FIG. 3*d* shows the flow control device entering an open position. The extended aperture 24 of the inner sleeve 15 has just moved past the seal 18 and encroaches slightly on the chamber 20, thus permitting a small amount of fluid to flow into the bore of the inner sleeve 15. Thus, a low rate of fluid flow through the flow control device is achievable. This was more difficult with the conventional chokes in which the apertures were of the same shape and size and were aligned; small changes in flow rate could only be achieved by minute deflections of the inner sleeve, which was very difficult owing to actuators being relatively crude positioning devices. In practice, there is usually more than one extended aperture 24, typically located at diametrically opposite points of the inner sleeve 15.

Prior to entering the aperture 24 of the inner sleeve 15, fluid entering the chamber 20 from the well is directed into the small annular passage 22 provided by the annular insert 21. The dimensions of the annular passage 22 are chosen so that a large proportion of the pressure of the inflowing fluid is dropped along the passage, that is to say there is a pressure differential between the ends of the passage. Therefore, fluid entering the inner sleeve 15 is at a lower pressure than was hitherto encountered with a conventional choke. This feature prevents the seal 18 being damaged or dragged into the apertures and also reduces erosion. The radial dimensions of the passage 22 need to be large enough, however, to prevent blockage from contaminants in the fluid.

Figure 3E:
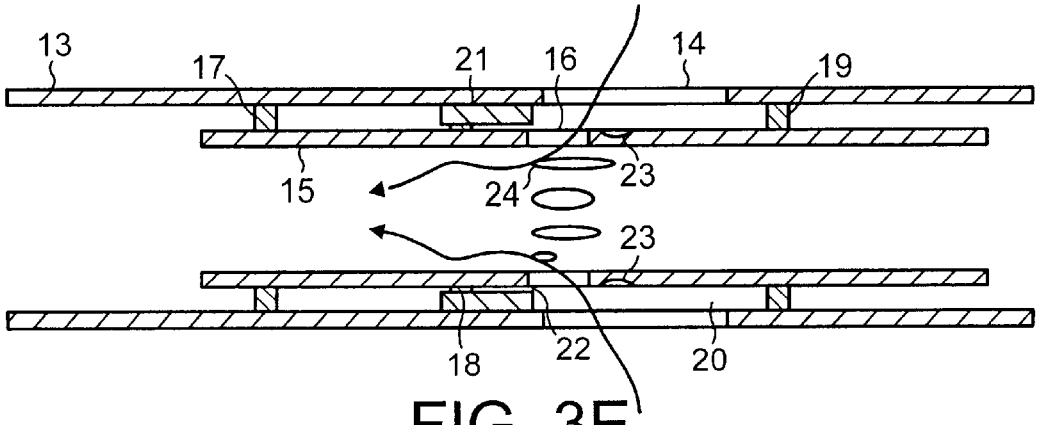

FIG. 3*e* shows the choke in the fully open position. In this position, fluid is able to flow through all of the apertures 16 in the inner sleeve 15, thereby producing maximum achievable flow into the production tubing. It should be noted that, as the actuator moves between the positions of FIGS. 3*d* and 3*e,* the effective length of the annular passage 22 reduces, so that the apertures 16 of the inner sleeve 15 are gradually exposed to increasing pressure, culminating in full exposure to the pressure of the inflowing fluid.

Figure 4:
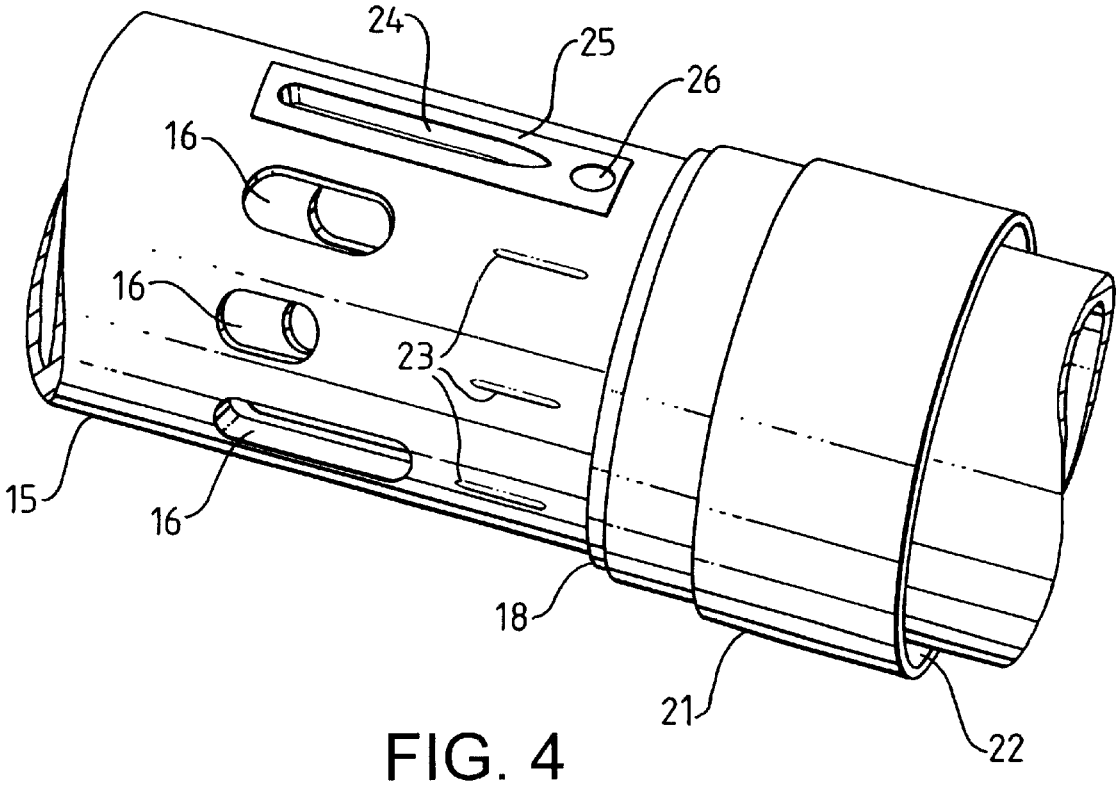
FIG. 4 is a perspective view of the apparatus of FIG. 3.

FIG. 4 shows the layout of the inner sleeve 15 more clearly. For illustrative purposes, the seal 18 is shown attached to the inner sleeve 15, as is the annular insert 21. The grooves 23 are also shown, positioned in front of all of the apertures 16 in the inner sleeve 15, except for the aperture 24. A further feature of this apparatus is that the extended aperture 24 includes an erosion-resistant insert 25, typically made of tungsten. The insert 25 is secured to the inner sleeve 15 by a screw fastener 26 at one end portion and has a lip-shaped contour at the other end portion, which engages in the aperture 24. The insert 25 is tapered around the edges of the aperture 24, thereby providing an effective tapering of the aperture, to further resist erosion. Of course, the apertures themselves could be tapered as an extra safeguard against erosion.

Figure 5:
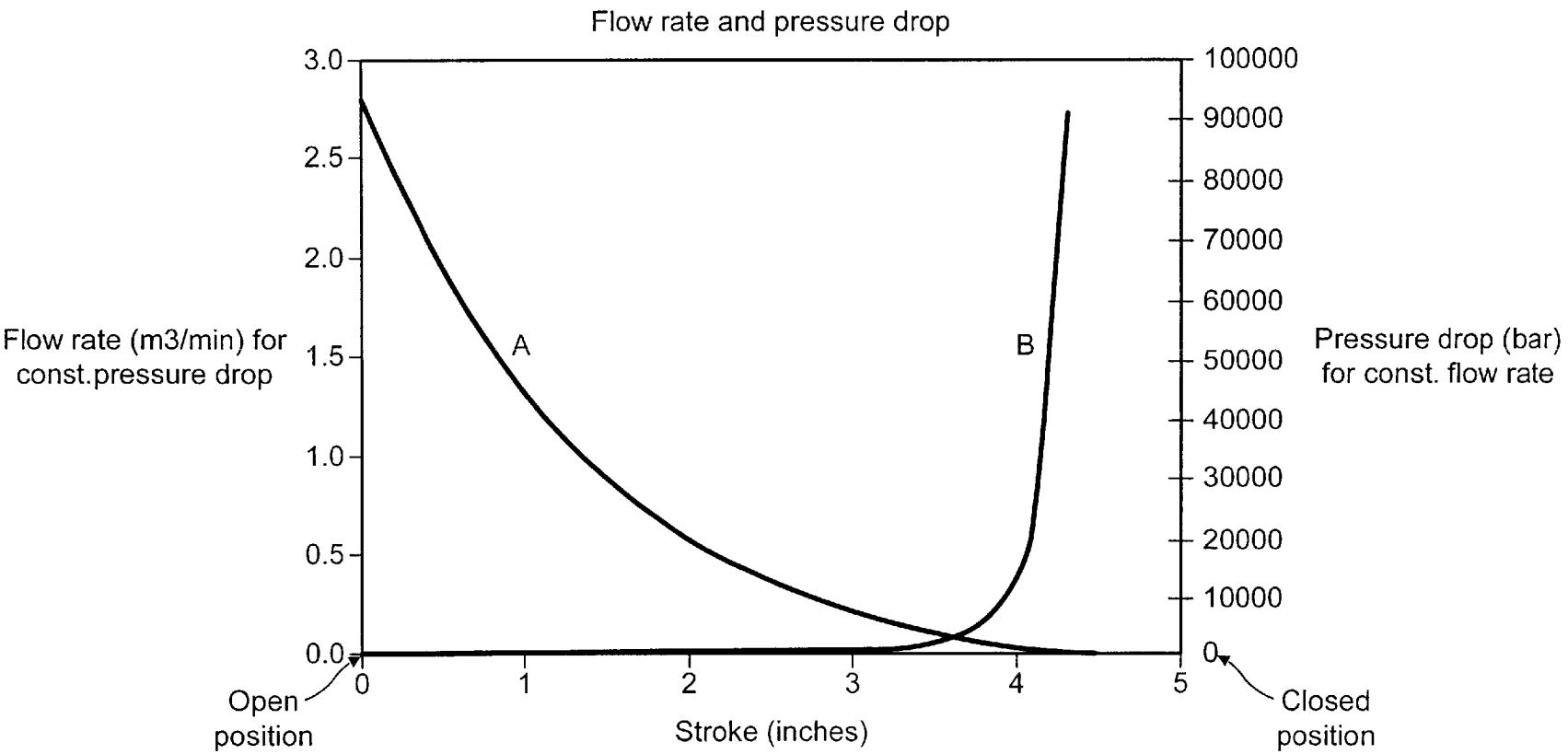
FIG. 5 illustrates graphically the change in flow rate and pressure drop achievable with the apparatus of FIG. 3.

The curve labelled A on FIG. 5 illustrates the change in flow rate achievable with the apparatus of the invention. The flow rate is plotted against the stroke of the inner sleeve, as moved by the actuator. This change in flow rate with stroke exhibits more linear characteristics than was hitherto achievable. Furthermore, very low flow rates are achievable. Previously, there was a step between zero flow rate in the closed position and the flow rate in the "just open" position. The corresponding graph of the pressure change across the apertures is also shown in the curve labelled B.

The invention is particularly suited to the control of chokes downhole in hydrocarbon wells, however it is eminently suitable for controlling the flow of fluid in general in other applications.

In a hydrocarbon well, usually only the inner sleeve is moved to control flow changes. In other applications, it may be more advantageous for the outer sleeve, or even both sleeves, to be moved by actuator mechanisms. A suitable actuator mechanism is that described in our co-pending U.K. Patent Application No. 9913037.9.

The invention has been described with respect to fluid flowing from a well bore into production tubing, i.e. from the exterior of the outer sleeve to the interior of the inner sleeve. However, the invention is equally suited to controlling fluid flow in the opposite sense, with either minimal or no further adaptation needing to be made. Further variations may be made without departing from the scope of the invention. For example, the annular insert need not be interposed between the seal 18 and the outer sleeve. The insert could be attached to the outer sleeve in front of the seal or else attached to the inner sleeve. The insert could even be formed with the seal as an integral part.

As a further variation, the erosion-resistant insert could be attached to the inner sleeve by, for example, chemical bonding or could even be an integral part of the sleeve. All of the apertures of the inner and/or outer sleeves could be made erosion-resistant in this manner.

What is claimed is:

1. A flow control device, comprising:

a) an outer sleeve having an outer sleeve wall and at least one aperture through the outer sleeve wall;

b) an inner sleeve having an inner sleeve wall and at least one aperture through the inner sleeve wall;

c) means for providing relative sliding movement of the sleeves between open positions allowing variable flow of fluid through the apertures of the sleeves, and closed positions;

d) a sealing arrangement between the inner and outer sleeves and comprising at least one seal; and e) seal bypass means for permitting a portion of the fluid to seep around said at least one seal so that fluid pressure acting on a region of said at least one seal is reduced.

2. The device as claimed in claim 1, in which the seal bypass means comprises at least one groove in the inner sleeve.

3. The device as claimed in claim 1, in which said at least one groove has a length exceeding that of a face of said at least one seal engaging the inner sleeve.

4. The device as claimed in claim 1, in which the seal bypass means is located on the inner sleeve before said at least one aperture of the inner sleeve in a direction of opening movement.

5. A flow control device, comprising:

a) an outer sleeve having an outer sleeve wall and at least one aperture through the outer sleeve wall;

b) an inner sleeve having an inner sleeve wall and at least one aperture through the inner sleeve wall;

c) an annulus between the inner and outer sleeves;

d) means for providing relative sliding movement of the sleeves between open positions allowing variable flow of fluid through the apertures of the sleeves, and closed positions; and e) a pressure-reducing region for reducing pressure of the fluid flowing through said at least one aperture of one of the sleeves, the pressure-reducing region comprising a region of the annulus of reduced size, the region of reduced size including a portion of the outer sleeve having a reduced inner diameter.

6. A flow control device, comprising:

a) an outer sleeve having an outer sleeve wall and at least one aperture through the outer sleeve wall;

b) an inner sleeve having an inner sleeve wall and at least one aperture through the inner sleeve wall;

c) an annulus between the inner and outer sleeves;

d) means for providing relative sliding movement of the sleeves between open positions allowing variable flow of fluid through the apertures of the sleeves, and closed positions; and e) a pressure-reducing region for reducing pressure of the fluid flowing through said at least one aperture of one of the sleeves, the pressure-reducing region comprising a region of the annulus of reduced size, the region of reduced size including a portion of the inner s&eve having an increased outer diameter.

7. A flow control device, comprising:

a) an outer sleeve having an outer sleeve wall and at least one aperture through the outer sleeve wall;

b) an inner sleeve having an inner sleeve wall and at least one aperture through the inner sleeve wall;

c) means for providing relative sliding movement of the sleeves between open positions allowing variable flow of fluid through the apertures of the sleeves, and closed positions; and d) a pressure-reducing region for reducing pressure of the fluid flowing through said at least one aperture of one of the sleeves, the pressure-reducing region having an effective size which changes as the device moves between the closed and the fully open positions so as to gradually expose said at least one aperture of said one of the sleeves to a full pressure of the fluid.

* * * * *